169-46 SR
5/4/76 XR 3,953,961

United States Patent [19]
Harrap et al.

[11] 3,953,961
[45] May 4, 1976

[54] METHOD AND APPARATUS FOR SPINNING YARNS ON OPEN-END SPINNING MACHINES AND PNEUMATICALLY REMOVING FIBER AND TRASH WASTE INCIDENT TO SPINNING

[75] Inventors: John Harrap, Prestbury; Richard Gordon Stewart, Heaton Mersey, both of England

[73] Assignee: Parks-Cramer (Great Britain) Ltd., Oldham, England

[22] Filed: July 5, 1974

[21] Appl. No.: 485,773

Related U.S. Application Data

[63] Continuation-in-part of Ser. No. 409,055, Oct. 24, 1973, which is a continuation-in-part of Ser. No. 366,963, June 4, 1973, abandoned.

[52] U.S. Cl. ..... 57/56; 15/319; 55/272; 55/350; 57/58.89; 57/156; 134/21; 134/18; 169/46; 169/60; 57/34 R; 57/58.95

[51] Int. Cl.[2] ..... A62C 3/04; B08B 5/04; D01H 1/12; D01H 11/00

[58] Field of Search ..... 134/21, 18, 37; 15/301, 15/319, 347, 352; 169/2 R, 46, 60; 55/261, 272, 273, 274, 294, 301, 302, 304, 305, 315, 350, DIG. 8, DIG. 29; 57/56, 58.89, 156

[56] References Cited

UNITED STATES PATENTS

| | | | |
|---|---|---|---|
| 2,355,664 | 8/1944 | McMann | 169/2 R |
| 2,685,939 | 8/1954 | Parrett | 55/301 |
| 3,627,584 | 12/1971 | Stewart | 134/21 |
| 3,777,329 | 12/1973 | Lane | 57/58.89 X |
| 3,777,466 | 12/1973 | Kabele et al. | 57/58.89 |
| 3,792,575 | 2/1974 | Doudlebsky et al. | 57/56 |
| 3,834,145 | 9/1974 | Ellingham et al. | 57/56 |
| 3,839,764 | 10/1974 | Clayton | 57/56 X |
| 3,845,612 | 11/1974 | Chisholm et al. | 57/56 |
| 3,859,779 | 1/1975 | Furstenberg | 57/58.89 |

*Primary Examiner*—S. Leon Bashore
*Assistant Examiner*—Richard V. Fisher
*Attorney, Agent, or Firm*—Bell, Seltzer, Park & Gibson

[57] ABSTRACT

A method and apparatus for removing fiber waste from yarn spinning rotors of open-end spinning machines and for removing trash waste liberated from fibers in their paths of travel to the respective rotors, utilizing a common primary airflow for drawing air from the rotors and for also drawing air adjacent the paths of travel of the fibers to the rotors so that the airflow adjacent such paths of travel will not interfere with movement of the fibers along such paths to the adjacent yarn spinning rotors. Preferably, the airflow from the rotors of each machine passes through a respective movable filter arranged to arrest fiber waste thereon periodically for intervals of predetermined duration permitting extinguishing of any fire which may have been ignited in the fiber waste being drawn from the rotors of the machines.

69 Claims, 7 Drawing Figures

BEATER
ROTOR
BEATER
ROTOR
BEATER
ROTOR
A
B

METHOD AND APPARATUS FOR SPINNING YARNS ON OPEN-END SPINNING MACHINES AND PNEUMATICALLY REMOVING FIBER AND TRASH WASTE INCIDENT TO SPINNING

This application is a continuation-in-part of our copending application Ser. No. 409,055, filed Oct. 24, 1973 and entitled METHOD AND APPARATUS FOR COLLECTING FIBER WASTE FROM OPEN-END SPINNING MACHINES which in turn is a continuation-in-part of our application Ser. No. 366,933, filed June 4, 1973, now abandoned.

This invention relates to open-end spinning machines of the type wherein a suction airflow communicates with the yarn spinning rotors of the spinning machine and is utilized for effecting the proper spinning function of the spinning rotors and to remove any excess fibers or fiber waste therefrom, and wherein any trash present in the slivers, during their passage through respective paths of travel to the spinning rotors, is removed or liberated from the slivers as by the action of toothed opener rollers engaging the slivers and opening up the fibers thereof while centrifugally casting the trash from the opener rollers into a trash collection chamber adjacent thereto.

With the foregoing in mind, it is the primary object of this invention to pneumatically remove fiber waste from yarn spinning rotors of open-end spinning machines of the character described and while also pneumatically removing trash waste, and wherein fan means common to all the machines is employed as the source of suction for removing both types of waste from a plurality or group of open-end spinning machines.

In the prior art of open-end spinning machines of the type with which this invention is concerned, it is well known, as exemplified by Stewart U.S. Pat. No. 3,627,584, that a high velocity air stream is necessary for applying a suction to the rotors of the machine for obtaining the desired yarn spinning action of the rotors while also removing any excess fibers from the rotors. It is further known, as exemplified by Lane U.S. Pat. No. 3,777,329, and by open-end spinning machines manufactured in accordance with this patent by Platt International Limited, the assignee of this patent, to penumatically remove, by a separate source of suction, trash waste liberated from the slivers.

It is also known, as disclosed in Landwehrkamp et al, U.S. Pat. No. 3,797,218, in open-end spinning machines also of the type with which the instant invention is concerned, to utilize suction or compressed air to periodically pneumatically remove accumulated trash waste from a trash collection chamber. As stated in this patent, the trash waste can only be removed pneumatically after first blocking a trash discharge opening communicating with the trash collection chamber as by closing a door, manually or automatically, to isolate the toothed opener rollers from the suction or compressed air during the trash removal operation.

It is further known to pneumatically remove trash waste on the so called "Czech-type" of open-end spinning machine, which type of machine is characterized by having spinning rotors which generate their own air and do not utilize a source of suction cooperating with the spinning rotors. Patents exemplifying this "Czech-type" open-end spinning machine with a source of suction for trash removal, are Kabele et al U.S. Pat. No. 3,777,466 and Doudlebsky et al U.S. Pat. No. 3,763,641.

With the foregoing in mind, it is a further object of this invention to provide a more economical waste removal system for a group of open-end spinning machines wherein a fan means to common to all of the machines serves as the source for providing the high velocity suction airflow to the spinning rotors of all of the machines in the group and also serves for providing the desired airflow for trash removal from all of the machines in the group.

A further more specific object of this invention is to provide a common fan means for effecting a high velocity airflow to remove fiber waste from the spinning rotors of an open-end spinning machine and for effecting a low velocity airflow for the removal of trash waste from the trash collection chambers of the machine. In this regard, many open-end spinning machines have relatively small trash collection chambers which are positioned closely adjacent each of the opener rollers, and therefore, such machines would not operate properly in the event the suction airflow was of a high velocity as it passes by the opener rollers. Such high velocity airflow passing by the opener rollers would result in the removal of usuable fibers from the opener rollers, which could not be tolerated.

It is still a further object of this invention to provide filters in the passageways of the high velocity airflow from the spinning rotors to arrest, for a predetermined period of time, the fiber waste removed from the spinning rotors so that in the event of a fire being present in the fiber waste, such fire will be arrested by the filters to permit the high velocity airflow to have an opportunity to blow out the fire without stopping the associated machine. Means are associated with the filters for sensing a fire and extinguishing the same to thus avoid the fire being carried downstream therefrom. This feature of the invention is quite important in that it permits isolation of any fire to the particular machine of the group of machines and thus permits continued operation of the other machines in the group in the event it becomes necessary to stop the machine at which the fire is present. In this regard, as is well known, stoppage of an open-end spinning machine results in all of the ends being parted, thus necessitating piecing up all of the ends before the machine is again in full operation. This piecing-up operation is done manually and is very tedious and time consuming and is therefore to be avoided.

Some of the objects of the invention having been stated, other objects will appear as the description proceeds when taken in connnection with the accompanying drawings, in which FIG. 1 is a schematic perspective view of the invention showing a typical installation of a plurality of open-end spinning machines provided with the improved filter waste and trash waste removing system of the present invention;

Figures 1, 2:
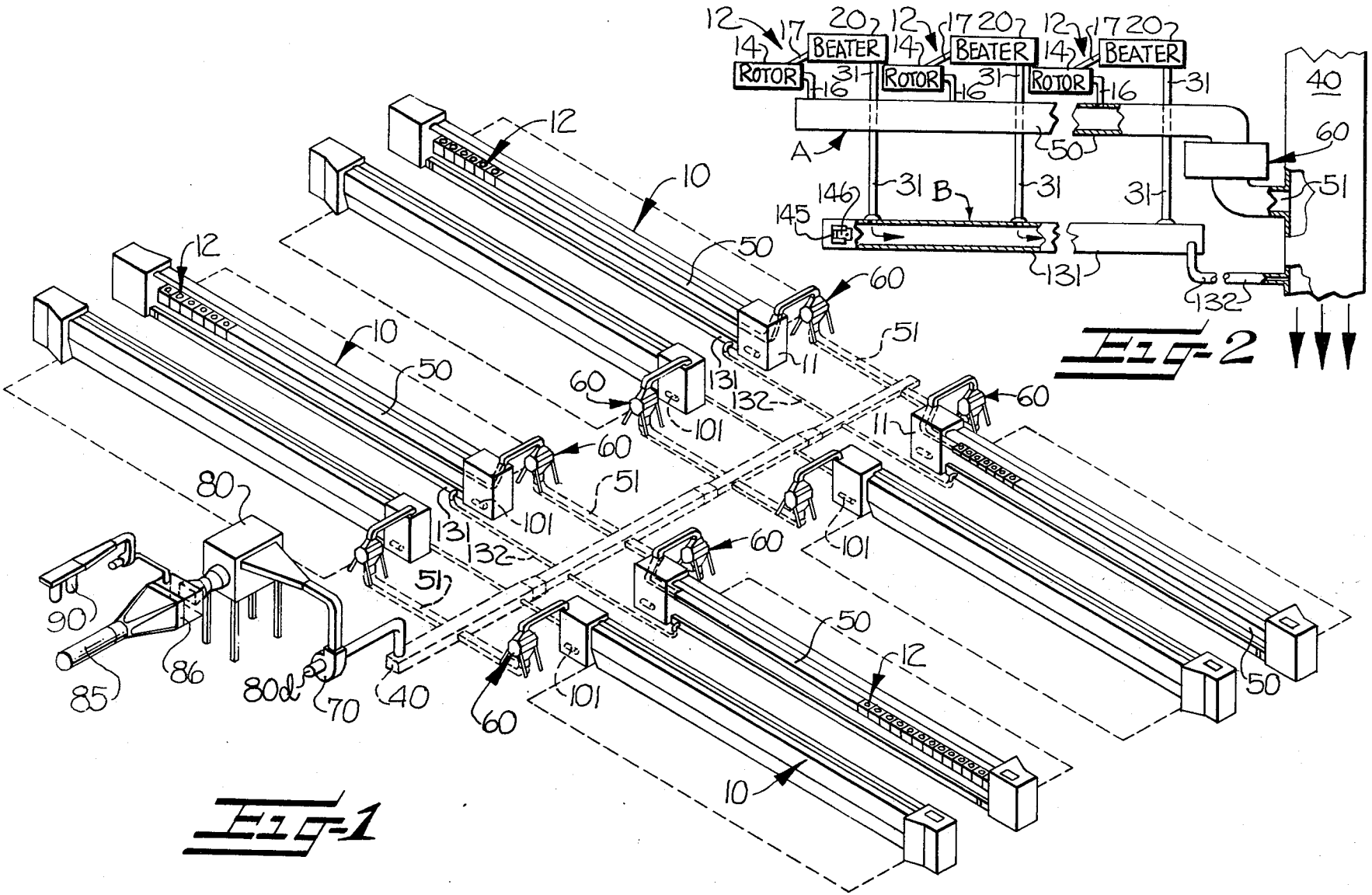
FIG. 2 is an enlarged schematic view illustrating a preferred embodiment of an arrangement of the airflow passageways from the rotors and trash collection chambers of one of the openend spinning machines of FIG. 1 to a common or main duct means along which a primary airflow is being produced.
Figure 6:
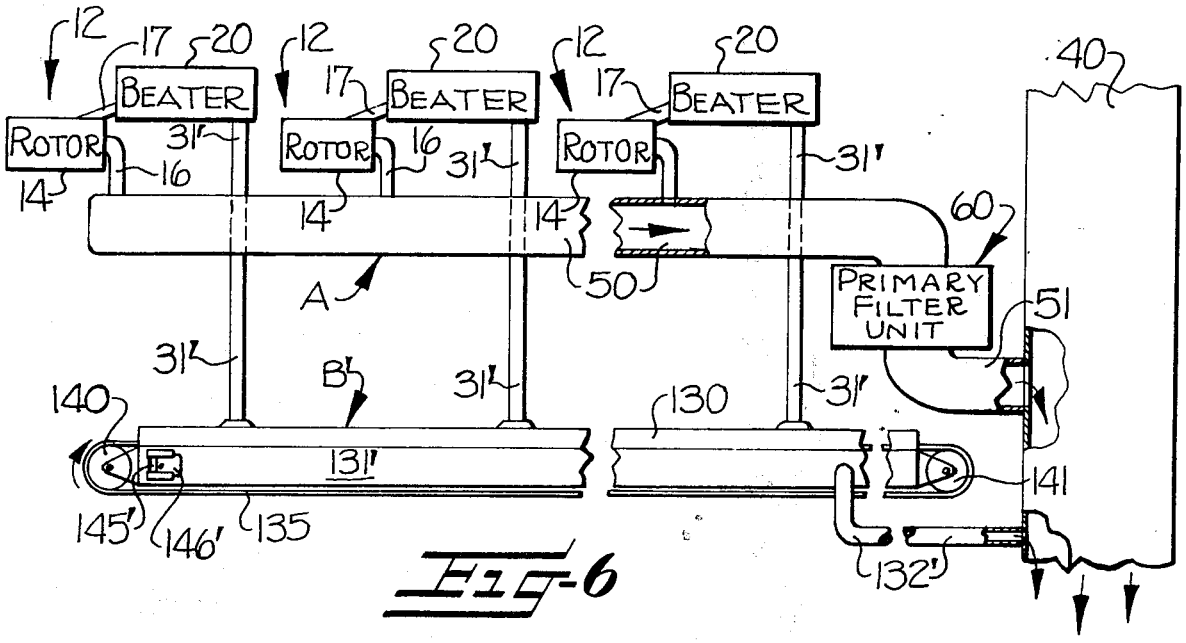
Figure 7:
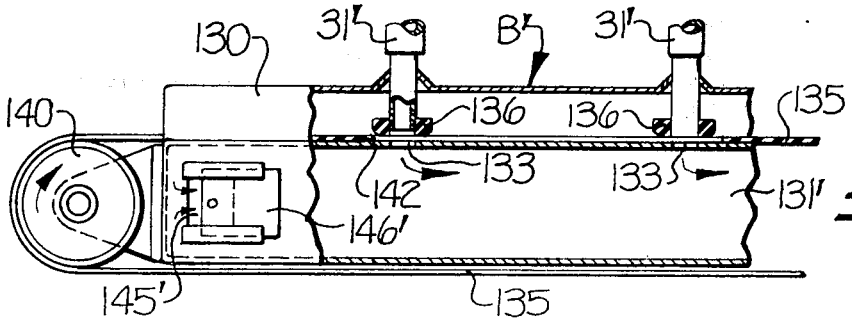

FIG. 6 is a view similar to FIG. 2 illustrating a modified embodiment of the airflow passageways as arranged for intermittently applying suction to the trash collection chambers for removing trash waste therefrom; and FIG. 7 is an enlarged fragmentary elevation of the left-hand lower portion of FIG. 6, mostly in section, illustrating a suitable means for effecting the intermittent suction at the trash collection chambers of each respective open-end spinning machine.

Referring more specifically to the drawings, and especially to FIG. 1, there will be observed a plurality or group of rotor-type open-end spinning machines, each of which is generally designated at 10, with the machines being arranged in two rows and in each row of which the machines extend in generally parallel relation to each other. The proximal ends of adjacent machines in the two rows are disposed adjacent opposite sides of an aisle separating the two rows of open-end spinning machines. Each machine 10 includes a row or series of open-end spinning units or stations broadly designated at 12. The spinning units 12 may be of the type as generally disclosed in the earlier mentioned Lane U.S. Pat. No. 3,777,329. One of such spinning units is shown somewhat in detail in FIG. 5, wherein the spinning unit 12 includes a rotary yarn spinning rotor 14, sometimes referred to as a "spinning chamber", suitably driven to rotate within a rotor chamber 15 to which one end of a fiber waste conveying suction tube 16 is communicatively connected for effecting a high velocity airflow through each rotor and rotor chamber, as will be later described.

Separated or opened fibers are directed to each rotor 14 through a conventional fiber conveying passage or duct 17 from a rotating beater or opener roller 20 disposed within a relatively closely confining beater chamber or opener roller chamber 21 formed in a housing 22. A fibrous strand S, in the form of a sliver, is fed to the opener roller 20 by a rotating feed roller 24 cooperating in a conventional manner with a feed plate 25. The yarn Y, formed of the fibers by the spinning rotors 14 and the airflow therethrough, may be withdrawn from rotor 14 by suitable driven rolls R.

The term "sliver" is used herein to mean a strand of untwisted, loosely connected fibers which may be readily opened or separated in its path of travel to the respective rotor 14.

As described above, the fibers are directed to each rotor 14 by a respective opener roller 20. As is conventional, each opener roller 20 is provided with peripheral teeth, needles or other projections thereon for combing out and separating or opening the sliver as it is moved in a predetermined path of travel partially defined by the gap between the opener roller 20 and the inner wall of housing 22 defining chamber 21. Thus, the fibers being directed to each rotor 14 travel along a path which changes direction so that, as the fibers move past a discharge opening 26 in housing 22 and upstream of feed duct 17, trash waste is liberated and thrown out from the fibers and is discharged, by centrifugal force, through the discharge opening 26 into a respective trash collection chamber 30.

As indicated earlier herein, the path along which the fibers travel in their course to each rotor 14 may be defined by means other than the periphery of the opener roller 20 and the wall of the housing 22 which defines chamber 21, just so long as the fibers are opened or separated and the trash waste is liberated therefrom before the fibers are drawn into the yarn spinning rotor 14 by a high velocity suction airflow. For example, such path of travel of the fibers may be defined by any suitable duct means or tube means so arranged as to produce a change of direction of movement of the fibers such as to throw out trash waste from the fibers through a trash discharge opening adjacent the zone of the change of direction of such path of travel as disclosed, for example, in FIGS. 5, 6, 12 and 13 of said Landwehrkamp et al U.S. Pat. No. 3,797,218.

Figure 5:
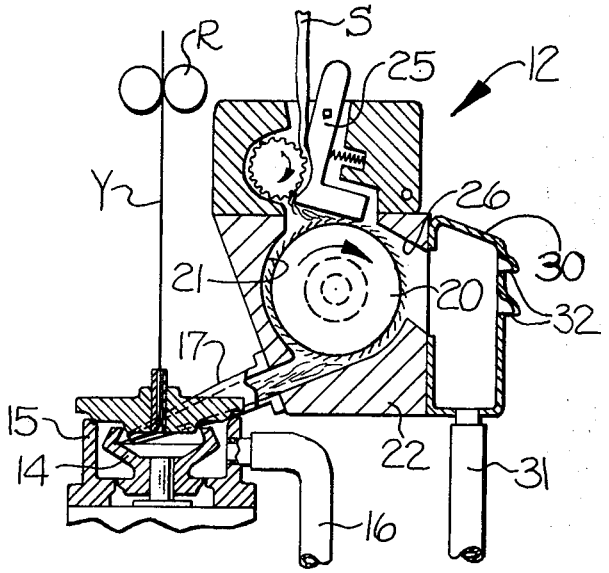
FIG. 5 is a schematic elevation, largely in crosssection, of a typical spinning unit of an open-end spinning machine from which rotor fiber waste and trash waste are removed in accordance with the invention.

As shown in FIG. 5, one end of a trash conveying suction tube 31 is communicatively connected to the lower portion or wall of trash collection chamber 30, there being a separate trash collection chamber 30 and trash conveying suction tube 31 for each spinning unit 12. The trash conveying suction tubes 31 serve to connect the trash collection chambers 30 of each machine to duct means of the respective machine as will be later described. Such duct means is subjected to suction, thus effecting a suction airflow adjacent the path of travel of each sliver S to the respective rotors 14 and through each trash collection chamber 30 into the respective suction tube 31.

As will be later explained more in detail, the suction airflow through each trash collection chamber 30 desirably is of substantially lower velocity than the high velocity airflow through each rotor 14 so as to remove the trash waste from each trash collection chamber 30 without withdrawing usable fibers from the sliver S being directed to the respective rotor and without interfering with the operation of the respective motor. To further insure that the trash-waste-removing airflow through each chamber 30 will not withdraw usable fibers from the path of travel of the fibers past the opener roller 20 to the respective rotor 14, it will be observed in FIG. 5 that the trash collection chamber 30 there shown is provided with one or more air ingress openings 32. Openings 32 are preferably located remote from opener roller 20 and are shown in the form of louvered openings through the upper portion of an outer side wall of the respective trash collection chamber 30.

It is to be noted that the rotor-fiber-waste conveying tubes 16 are elements of a first passageway-defining means, broadly designated at A, associated with each open-end spinning machine 10 for communicatively connecting a common primary airflow duct means 40 with the rotor chambers 15, and thus, with the rotors 14 of each respective machine 10 in the group. Similarly, the trash conveying tubes 31 are elements of a second passageway-defining means, broadly designated at B, for communicatively connecting the common duct means 40 with the chambers 21 for opener rollers 20 (FIG. 5) and the trash collection chambers 30 of each machine 10. Such second passage-defining means B is arranged in parallel with the first passageway-defining means A of each respective machine 10 and will be later described.

As shown in FIGS. 1 and 2, each first passageway-defining means A is arranged so that the primary airflow in common duct means 40 will draw air at a high velocity past the rotors 14 of each machine into main or common duct means 40. Therefore, each first passageway-defining means A further comprises a first elongate airflow channel or manifold conduit 50 which extends along the length of the respective open-end spinning machine 10. The outlet ends of the rotor-fiber-waste conveying tubes 16, remote from the chambers 15 containing the rotors 14 of each respective machine 10, are communicatively connected to manifold conduit 50 (FIG. 2).

The end of each rotor manifold conduit 50 remote from the common duct means 40 preferably is closed, with the other end thereof being communicatively connected to the common duct means 40 through the medium of a respective primary filter unit or filter box 60 and an extension conduit 51. The major portion of the common primary airflow duct means 40 and the conduit extensions 51, as well as other ducting 132 to be later described, are shown in broken lines in FIG. 1 to indicate that they may be hidden in or under the floor of the spinning room, if desired.

Figure 3:
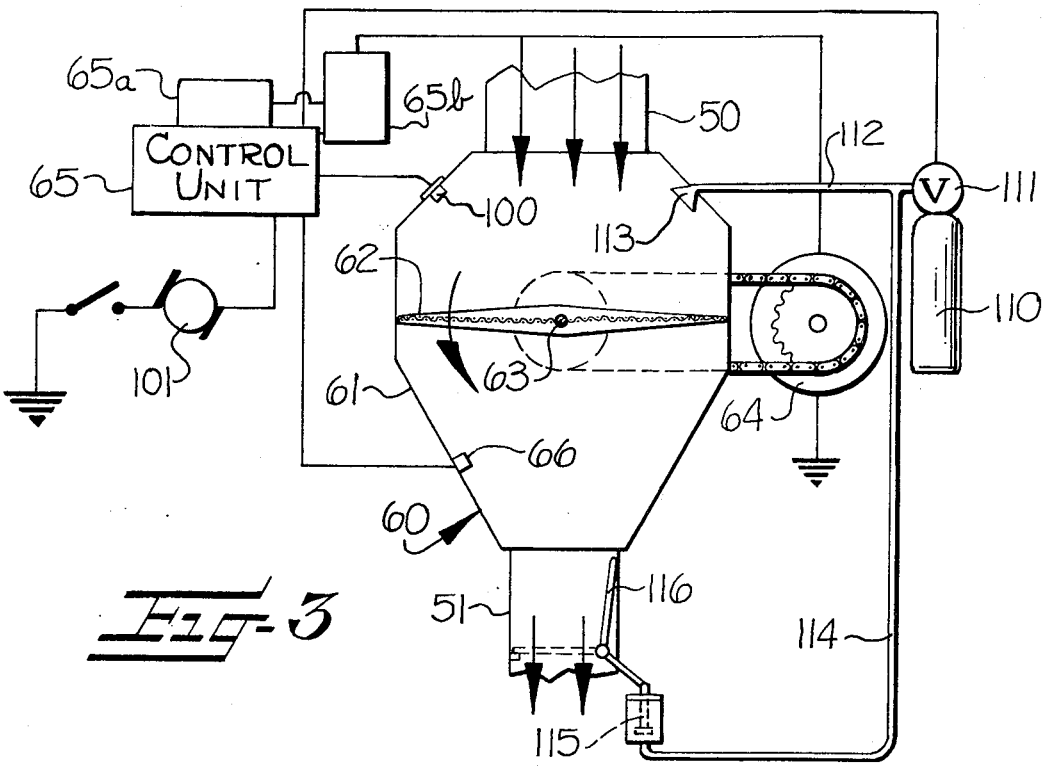
FIG. 3 is a schematic vertical sectional view through a suitable primary or arresting filter unit interposed in the airflow path between the spinning rotors of each respective openend spinning machine and the main or primary airflow duct means.

Each primary filter unit 60 may be constructed and operated in substantially the same manner as the primary filter units 20 disclosed in our said copending application Ser. No. 409,055, the disclosure of which is incorporated herein by reference. Accordingly, only so much of the primary filter units 60 will be described as is deemed necessary to a clear understanding of the present invention. Referring to FIG. 3, it will be observed that the primary filter box 60 there shown comprises a housing 61 having proximal ends of the respective manifold conduit 50 and the conduit extension 51 communicatively connected to upper and lower portions thereto. A primary filter 62, also serving as a fiber waste arresting filter and which may be of substantially flat rectangular form, normally occupies a substantially closed position transversely of the direction of airflow through housing 61 for entrapping and arresting thereagainst fiber waste being drawn from the rotors of the respective machine 10 for periods of predetermined duration such as to permit the extinguishing of any burning fiber waste which may have been ignited at any of the respective rotors 14 (FIGS. 2 and 5), as will be later explained more in detail.

In order to maintain a substantially constant and relatively high velocity flow of "spinning air" through the rotors 14 of each open-end spinning machine 10 during operation thereof, so as to insure production of high quality yarn, it is necessary that successive masses of fiber waste arrested against each primary filter 62 are periodically dislodged therefrom into the airflow downstream of the respective primary filter 62 so that such dislodged fiber waste will be conveyed into the common duct means 40 under the influence of the primary airflow therein. It should be noted that the term "periodically" is used herein with respect to operation of each primary filter to mean that each primary filter may be operated as spaced intervals of predetermined uniform or random duration just so long as the fiber waste collected thereon is arrested for intervals of such duration that any burning fiber waste ignited at the respective rotors may be extinguished and the fiber waste collected on the primary filters will be dislodged therefrom at sufficiently frequent intervals to insure that the primary airflow in duct means 40 will continuously draw air at a substantially constant high velocity from the rotors of the respective spinning units 12 during operation of each respective machine 10.

Accordingly, to facilitate changing the position of each primary filter 62, such filter is rotatably mounted on an axis extending across the flow of air through filter box 60 by means of a transverse shaft 63 (FIG. 3) journaled in suitable bearings, not shown, carried by opposing side walls of filter box housing 61. As indicated in FIG. 3, each primary filter 62 may be rotated approximately one-half a revolution periodically and at predetermined spaced intervals, as by means of an electric motor 64 drivingly connected to shaft 63. Motor 64 may be controlled by a suitable control unit schematically illustrated in 65 in FIG. 3.

Control unit 65 normally controls motor 64 so that primary filter 62 will be inverted with respect to the direction of airflow each time motor 64 is energized. As disclosed in said copending application, motor 64 may be controlled to operate periodically by a suitable timing device, not shown, or by a suitable pressure detecting device 66 positioned within the filter box housing 61 of each respective open-end spinning machine 10. If a pressure detecting device is employed in each filter box 60 for controlling the respective motor 64, such pressure detecting device should be capable of quickly effecting actuation of the respective motor 64 for a predetermined period of time such as to invert filter 62 upon an undesirable reduction in the suction airflow through the respective manifold conduit 50 and filter box 60 occurring as the result of an excessive amount of fiber waste being entrapped against the upstream side of the respective primary filter 62.

In any event, the control of each motor 64 is such that a substantial predetermined time interval elapses between successive inversions of each arresting or primary filter 62. Such time interval is provided to insure that there is simple time during which fiber waste being drawn from the rotors 14 of each machine 10 is arrested by the respective filter 62 to permit extinguishing a fire in any burning fiber waste which may have been ignited at any of the rotors 14. It is apparent that it is desirable that each inversion of each primary filter 62 be effected as rapidly as is practicable. In actual practice, it has been found convenient to have the control unit 65 of each machine 10 operate in such a manner as to invert the respective filter 62 at intervals of about 40-120 minutes, for example, with only a few seconds being required for effecting each inversion of each filter 62. The manner in which a fire in any burning fiber waste being arrested by any of the filters 62 is extinguished will be later described.

In the illustrated embodiment of the invention, the primary airflow is induced in the common duct means 40 by a suitably driven fan means; i.e. a suction fan or suction blower 70 (FIGS. 1 and 4) connected to or interposed in the primary airflow duct means 40 and whose air input side is disposed downstream of all of the first passageway-defining means A, each of which is composed of the elements 16, 50, 51 and 60 shown in FIG. 2. Of course, fan 70 also is downstream of all the second passageway-defining means B to be later described. The exhaust side of suction blower 70 is communicatively connected to the inlet of a secondary filter box 80 containing a secondary filter 81 (FIG. 4) therein for collecting waste material from all of the open-end spinning machines 10 in the group shown in FIG. 1.

Figure 4:
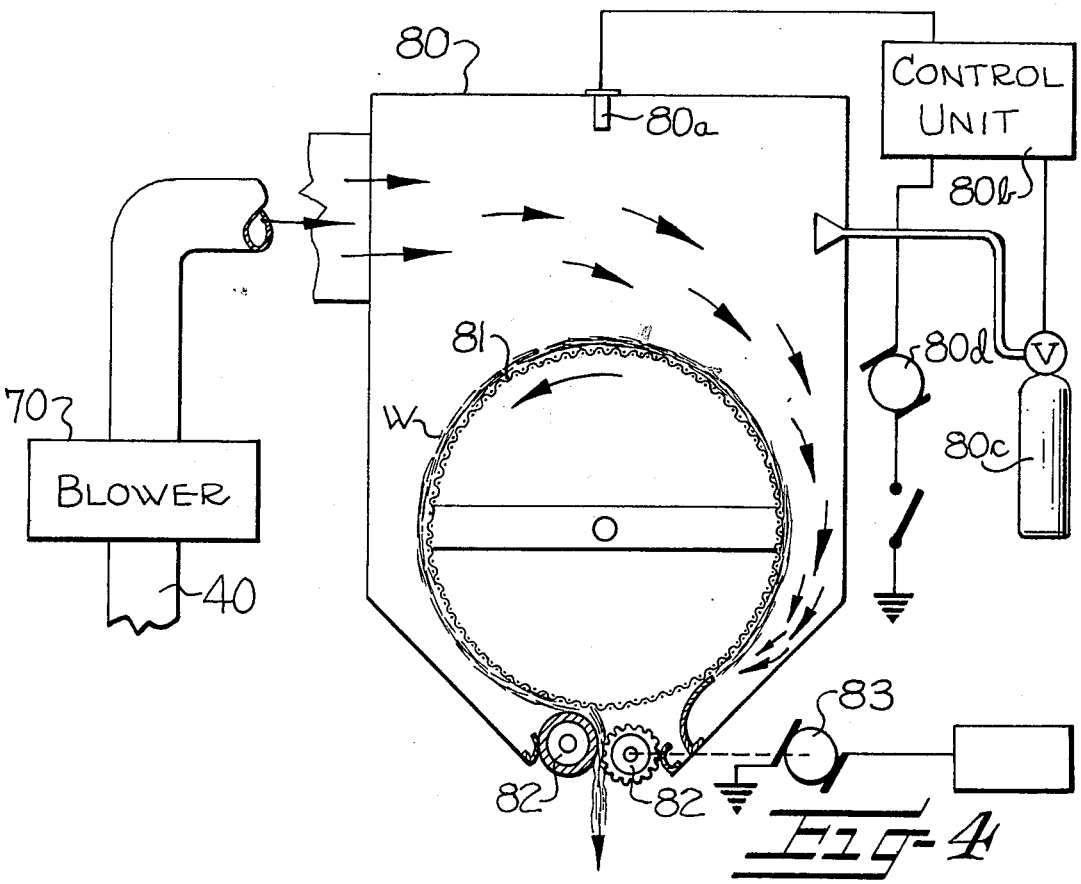
FIG. 4 is a schematic fragmentary vertical sectional view through a suitable secondary filter shown in the form of a rotary filter unit which receives the waste material from both the rotors and the trash collection chambers of all of the machines of FIG. 1.

As shown in FIG. 4, secondary filter 81 is in the form of a rotary drum filter capable of collecting thereon a mat or web W of fibrous waste material, which web W may be removed by withdrawing the same from the peripheral outer surfce of rotary filter 81, as by means of a pair of stripping rollers 82. The web W is discharged from the bottom portion of secondary filter box 80 by the rollers 82 and may be collected in a suitable container or truck, not shown, for subsequent disposal. For purposes of illustration, it will be observed in FIG. 4 that rollers 82 may be driven either continuously or at spaced intervals by a suitably controlled motor 83 to insure that the airflow through filter will be substantially constant. The secondary filter box 80 may be of a type such as is disclosed, for example, in U.S. Pat. No. 3,628,313, issued to Arnold Broadbent on Dec. 21, 1971. Accordingly, a further more detailed description of filter box 80 and the rotary filter 81 therein is deemed unnecessary.

It is apparent that the surface area of secondary filter 81 should be sufficient to receive thereon a composite waste material of the fiber waste and the trash waste being generated by operation of all of the textile machines 10 shown in FIG. 1 and that the waste material is removed from the upstream side or outer peripheral surface of secondary filter 81 to insure that there is not an undesirable drop in the rate of airflow through the common primary airflow duct means 40. For the purpose of this disclosure, filter box 80 also may be termed as a common waste collection zone for the waste material being removed from the rotors and opener rollers of all of the machines 10.

As shown in FIG. 1, any fine dust or fly which may penetrate rotary filter 81 is discharged from one open-end portion of filter box 80 into an air circulating duct system 85. Duct system 85 may serve to distribute the air being discharged by the suction blower 70 back into the room within which the open-end spinning machines 10 of FIG. 1 are positioned as is further disclosed in said copending application. Accordingly, a suitable fine-dust filter 86 is interposed between duct system 85 and secondary filter box 80. The fine-dust filter 86 may be of a type such as is disclosed in Sherrill's U.S. Pat. No. 3,303,635 dated Feb. 14, 1967, for example, which filter is provided with a suitable suction nozzle means, not shown, for continuously cleaning the same. Such suction nozzle means is arranged to continuously remove and discharge the collected fine-dust fibrous material from filter 86 into suitable removable filter bags 90 which may be arranged and constructed in substantially the manner described in U.S. Pat. No. 2,500,123, which issued on Mar. 7, 1950, to E. C. Gwaltney et al. Accordingly, a further disclosure of the fine-dust filter 86, the means for keeping the same clean and the filter bags 90 is deemed unnecessary.

As indicated earlier herein, the fiber waste drawn from the rotors 14 of each machine 10 is arrested by the respective primary filter 62 (FIG. 3) for a predetermined period of time such as to permit extinguishing a fire a any burning fiber waste which may have been ignited at any of the rotors 14. According to the invention, such a fire is sensed, and in response thereto, the respective machine 10 may be stopped and the fire is extinguished. Since it has been found that in most instances such a fire may be extinguished by the high velocity airflow, per se, through the respective filter 62 within only a few seconds of such fire being sensed initially, it is preferred that the presence of such a fire is sensed for a predetermined time interval prior to interrupting the operation of the respective machine so as to permit the high velocity airflow to have an opportunity to blow out the fire without interfering with the normal operation of the respective machine. However, if the fire is not extinguished quickly; e.g., within three to five seconds, the fire will be extinguished by a fire extinguishing means as operation of the respective machine is interrupted and the airflow through the respective filter is interrupted, as will be presently described.

It has been determined that most fires, which may be present in the fiber waste being arrested by any of the primary filters, are quickly blown out or extinguished by the high velocity, high volume airflow being effected through each filter box 60 at all times during normal operation of the respective machine 10. This is highly desirable because, any time that the operation of any of the open-end spinning machines is interrupted, all of the ends of yarn Y break at the spinning units 12 of the respective machine and must be pieced up in properly restarting the machine. Thus, it can be appreciated that considerable down-time and expense may be avoided if any fire at any of the arresting filters is extinguished by the airflow, per se.

However, as indicated above, in order to avoid spreading of a fire if it is not extinguished quickly by the airflow, an electrical signal produced in the respective control unit 65 by a sensing device 100 (FIG. 5) in each primary filter box 60 is effective to shut down the respective machine and to interrupt the airflow through the respective filter 62 concurrently with activating a normally inactive fire extinguishing means to extinguish the corresponding fire, without adversely effecting the operation of any of the other open-end spinning machines 10 in the group.

In this regard, it should be noted that a very important reason why a separate primary filter box 60 is provided for each open-end spinning machine 10, in addition to the common secondary filter box 80 (FIGS. 1 and 4), is to insure that the fiber waste generated by the rotors 14 of each machine is arrested at intervals of such duration that the occurrence of any burning condition; i.e., fire, spark or smoldering condition, of the fiber waste at the particular machine 10 may be readily sensed by automatic means. Therefore, each of the primary filter units or boxes 60 is equipped with the respective sensing device 100.

Each sensing device 100 preferably is in the form of a flame and/or smoke sensing means, and is connected to related circuitry embodied in control unit 65 (FIG. 3) for effecting the various operations described so as to prevent spreading of the fire and the occurrence of a conflagration as a result of the presence of a fire in the fiber waste adjacent any of the primary filters 62. Sensing device 100 will be termed hereinafter in the generic sense as a "fire" sensing device or detector for the purpose of this disclosure. Various types of fire sensing devices may be used. However, it has been found that the most efficient fire sensing device which may be used with open-end spinning machines is an infrared light-sensitive cell which will quickly detect a spark or flame which may have been generated by any one of the rotors 14 of the respective open-end spinning machine and conveyed along the manifold conduit 50 into the respective primary filter box 60. Although sensing device 100 is shown located upstream of filter 62 in FIG. 3, it is apparent that sensing device 100 may be located downstream of filter 62 or at any convenient location for sensing the presence of a fire in the arrested fiber waste at filter 62.

As disclosed in said copending application, secondary filter box 80 of FIG. 4 may be provided with a fire sensing means functioning in a manner similar to the fire sensing means associated with each primary filter box 60 and arranged so that, in the event of the presence of a fire in the waste material being entrapped against the secondary filter 81, all of the machines 10 will be shut down, the airflow therethrough, or blower 70, will be cut off and the burning waste material will be extinguished adjacent the secondary filter 81. In the latter instance, the airflow into the primary airflow duct means 40 also may be interrupted since the sensing means associated with the secondary filter box 80 may be arranged and operated in substantially the same manner as that described in said copending application. A sensing means 80*a*, a control means 80*b*, a fire extinguishing means 80*c* and a drive motor 80d for blower 70 are shown schematically in association with secondary filter box 80 in FIG. 4, and since they may operate as described in said copending application, a further description thereto is deemed unnecessary.

It is important to note that, if the primary filter 62 and corresponding fire sensing and responsive equipment were not provided for each individual open-end spinning machine, but instead, any burning condition were only to be sensed at the common filter embodied in filter box 80, this would require that the fire sensing means or device 80*a* associated with filter box 80 be effective whenever a fire occurred at any of the machines 10 to stop the operation of the main suction fan or suction blower 70, along with stopping operation of all the spinning machines, which would result in a considerable loss of production. Such a condition could occur simply as a result of a spark emanating from a single spinning unit 12. However, this problem is substantially eliminated by providing the separate arresting filter 62 and associated fire sensing device 100 and related equipment heretofore described at each of the open-end spinning machines 10.

As indicated, it has been determined that in most instances the airflow, per se, through the manifold duct of the particular machine 10 will serve to quickly extinguish any burning fiber waste which may be arrested by the respective primary filter 62. Therefore, it is preferred that each control unit 65 is provided with a suitable time delay mechanism, schematically indicated at 65*a* (FIG. 3), for effecting a delayed activation of control unit 65 for a predetermined period of such time as to provide an opportunity for the relatively high velocity suction airflow through the respective filter 62 to blow out and thereby extinguish the arrested burning fiber waste without stopping operation of the corresponding open-end spinning machine 10.

Suitable means, embodied in an override relay 65*b*, is also operatively associated with delay mechanism 65*a* and control unit 65 to cause control unit 65 to interrupt the circuit to filter driving motor 64, if it is then operating, or to otherwise delay operation of motor 64, immediately upon the sensing of the presence of a fire in the fiber waste being arrested by the respective primary filter 62. The override relay 65*a* and the associated circuitry may be of any suitable form which will render filter driving motor 64 inoperative for an interval about the same as or slightly greater than the delay interval of delay mechanism 65*a* following the sensing of a fire by sensing device 100. Thereupon, if the delay interval of delay mechanism 65*a* expires before the airflow extinguishes the fire, then operation of the respective machine 10 will be stopped and filter motor 64 will remain inoperative until the operator restarts the respective machine.

On the other hand, if the airflow extinguishes the fire before the time cycle or delay interval of delay mechanism 65a is completed or expires, then upon expiration of the delay interval, the override relay 65*a* will be inactivated so that the respective filter driving motor 64 will operate at the desired predetermined intervals under control of a timer, not shown, or the pressure sensing device 66, as heretofore described.

Now, if the airflow does not extinguish the burning fiber waste within a predetermined relatively short interval of time; e.g., within about 3 to 5 seconds, delay mechanism 65*a* not only renders control unit 65 effective to continue the inactive condition of filter driving motor 64, but it also stops a main drive motor 101 (FIGS. 1 and 3) of the respective open-end spinning machine, thus stopping the operation of the rotors 14 and opener rollers 20 of all of the spinning units 12 of the respective open-end spinning machine 10.

At the same time that the operation of both motors 64, 101 of any machine 10 is interrupted, a respective normally inactive fire extinguishing means is activated. To this end, it will be observed in FIG. 3 that the fire extinguishing means associated with each open-end spinning machine may include a container 110 of a pressurized fire extinguishing material, which may be in the form of a liquid, chemical, powder, or gas. For example, container 110 may contain a supply of pressurized carbon dioxide gas. Thus, upon activation of control unit 65 by sensing device 100 and delay mechanism 65*a*, a normally closed electrically response valve means 111, associated with container 110, is opened to permit the pressurized fire extinguishing material to flow from container 110 through a pressure line or conduit 112 to one or more discharge nozzles 113 positioned in the respective primary filter box 60 so as to subject the entire interior thereof, including the respective filter 62, to the fire extinguishing material and thereby extinguish any burning fiber waste therein.

At the instant that the fire extinguishing material is flowing to nozzle 113, it also is flowing through a branch conduit 114 from the respective conduit 112 to a normally inactive damper control unit 115. Upon consequent activation of damper control unit 115, and in response thereto a normal open damper or flap valve 116 (FIG. 3), within the respective conduit extension 51, moves from the solid-line open position of FIG. 3 to the broken-line closed position. It is apparent that this interrupts the flow of air through the corresponding extension conduit 51 and filter box 60 at substantially the same instant that the drive motor 101 for the respective open-end spinning machine 10 is stopped. Also, damper 116 then avoids loss of fire extinguishing material from the respective primary filter box 60 along conduit extension 51 and into the primary airflow duct means 40.

From the foregoing description, it can be appreciated that, upon a fire or burning condition being sensed by sensing device 100, (FIG. 3) such as to activate delay mechanism 65*a* and control unit 65 following a predetermined delay, if the fire has not been extinguished by the airflow, communication between the respective primary filter box 60 and the common secondary filter box 80 is interrupted, the flow of air through the corresponding first passageway defining means A, including manifold conduit 50, conduit extension 51 and the respective primary filter box 60, is interrupted, the respective filter drive motor 64, if then active, is rendered inactive, and the motor 101 is stopped so that the operation of the open-end spinning units 12 of the respective machine 10 are interrupted without intefering with the operation of the remaining machines 10 in FIG. 1. The control circuit associated with secondary filter box 80 in FIG. 4 may operate in a manner somewhat similar to that described for each primary filter box 60, with the exception that all of the drive motors 64, 80d, 83, 101 of FIGS. 1, 3 and 4 may be shut down upon detection of a fire by sensing means 80*a*, substantially as disclosed in our said copending application Ser. No. 409,055. Accordingly, a further description of the electrical circuits of FIGS. 3 and 4 is deemed unnecessary.

As indicated earlier herein, trash waste liberated from the fibers in their path of travel to the respective rotor; e.g., trash waste liberated from the fibers as they move in engagement with the respective opener rollers 20 (FIG. 2) of each machine 10, is withdrawn from the trash collection chambers 30 by a suction airflow induced by the primary airflow effected in duct 40 by suction fan 70. The trash waste removing suction airflow adjacent the paths of travel of the fibers past the opener rollers 20 must be such that the airflow will not draw usable fibers from the rotors 14 cooperating therewith and will not adversely affect the yarn spinning function of the rotors.

In the illustrated embodiment of the spinning unit 12 in FIG. 5, it will be observed that the trash collection chamber 30 there shown is quite small, as is generally desired due to the space limitations of open-end spinning machines of the type described. Accordingly, the walls of the trash collection chamber 30 are positioned closely adjacent the trash discharge opening 26 and the opener roller 20 of the spinning unit 12.

It can be appreciated therefore, that the bottom wall of trash collection chamber 30 is closely adjacent the respective opener roller 20 and the path of travel of the fibers past the opener roller 20 in their course to the rotors 14. With the walls of the trash collection chamber 30 in such relation to the opener rollers 20 as illustrated in FIG. 5, it is necessary that the trash-waste-removing suction airflow adjacent the paths of travel of the fibers and through the trash collection chambers 30 be of a substantially lower velocity than that of the airflow past the rotors 14. Accordingly, in the illustrative embodiments of the invention, the primary airflow produced through the duct means 40, in addition to being utilized for drawing air at a high velocity from the rotors of each machine, is utilized to draw air at a substantially lower velocity adjacent the paths of travel of the fibers past the opener rollers or beaters 20 of each respective machine 10.

In the preferred embodiment, the trash removal apparatus is arranged substantially as shown in FIG. 2 so that a continuous low velocity suction airflow is effective in each trash collection chamber 30 to continuously draw trash waste therefrom during operation of the machine 10. As shown in FIGS. 2 and 5, the trash removal apparatus is embodied in the second passageway-defining means B connecting the beaters or opener rollers 20 of the spinning units 12 of each respective machine 10 to the primary airflow duct means 40 in such a manner that the primary airflow draws air at a low velocity through the trash collection chambers 30 as compared to the high velocity of the air being drawn through the adjacent yarn spinning rotors 14. As preferred, to avoid drawing air from sliver ingress passage at feed roller 24 (FIG. 5) and through trash-discharge opening 26 of each spinning unit, the air ingress opening or openings 32 are provided in the outer wall of each trash collection chamber 30 as heretofore described.

As the description proceeds, it will become apparent that the second passageway-defining means B bypasses the primary filter box 60 of the respective machine 10. This is preferred because the relatively large quantity and density of the trash waste being removed from the trash collection chambers 30 might require that the respective primary filter 62 be rotated at intervals of undesirably high frequency. However, it is to be understood that, if desired, the second passageway-defining means B may be communicatively connected to the upstream side of the respective primary filter box 60, as by being connected to the manifold conduit 50 at a point between filter box 60 and the adjacent spinning unit 12 so that the trash waste being removed from the corresponding collection chambers 30 also may be drawn through the adjacent primary filter box 60.

The trash conveying tubes 31 (FIGS. 2 and 5) of each second passageway-defining means B may extend downwardly and be communicatively connected to a respective, second, trash conveying manifold conduit 131. The second manifold conduit 131 may be of about the same size as first manifold conduit 50, but in order to provide for the flow of air therethrough at a low velocity as compared to the velocity of the airflow along manifold conduit 50, one end portion of trash conveying manifold conduit 131 is communicatively connected to the primary airflow duct means 40 by a small bore ducting or tube 132 of relatively small internal cross-sectional area compared to that of manifold conduit 131. Thus, ducting 132 serves as a restricted passageway or flow restricting means interposed between each trash conveying manifold conduit 131 and primary airflow duct means 40 so that a low velocity flow of air through the trash conveying manifold conduit 131 is effected by the primary airflow in duct means 40.

Since a common source of suction is provided for effecting the suction airflow through both the first and second airflow passageway-defining means A, B of all of the machines 10 of the group shown in FIG. 1, it is preferred that the capacity of suction blower 70 is such as to produce a somewhat greater volume airflow through each of the trash conveying manifold conduits 131 than normally would be required so that the optimum velocity of airflow through the trash collection chambers 30 of each of the open-end spinning machines may be established at the will of the operator. Accordingly, it will be observed in FIG. 2 that the manifold conduit 131 there shown, which also serves as an air expansion chamber for tubes 31, is provided with an air inlet aperture or opening 145 in one wall thereof which may admit ambient air to the respective manifold conduit 131. The effective size of aperture 145 may be manually adjusted by a suitable valve means or cover 146. It is apparent that, by adjusting cover 146 relative to opening 145, the amount of ambient air which may enter the respective manifold conduit 131 under the influence of the primary airflow in duct means 40 may be accurately predetermined, to in turn, accurately predetermine the relatively low velocity of the airflow through the trash collection chambers 30 of the respective spinning units 12.

In a typical installation of the apparatus substantially as illustrated in FIG. 1, the capacity of suction blower 70, the size of primary airflow duct means 40 and size of the first and second passageway-defining means A, B associated with each open-end spinning machine 10 were such that, during normal operation of the open-end spinning machines, air was drawn through each rotor 14 at a rate of about 2.8 cubic feet per minute to 5.0 cubic feet per minute at respective static water gauge pressures of about 14.7 to 32.7 inches, with the optimum rate of flow of the air through each rotor being determined in actual tests to be about 4.0 cubic feet per minute at 21.0 inches static water gauge pressure but being varied somewhat according to the staple length of the fibers in the slivers S (FIG. 5) being spun into yarns Y.

In order to effect efficient removal of trash waste from the immediate vicinity of each beater 20 (FIG. 2) without drawing excessive fibers away from the adjacent rotors 14 and without otherwise adversely affecting the yarn spinning operations of the respective adjacent rotors, it was found that the static water gauge pressure, and thus the velocity, of the airflow through each trash collection chamber 30 should be substantially less than that of the airflow past each respective rotor 14. For example, an airflow of about 6.0 inches static water gauge pressure at 4.0 cubic feet per minute was found to be quite effective to remove trash waste from the trash collection chambers 30 (FIG. 5) of each machine, although the actual volume of the airflow and the static water gauge pressure thereof may best be determined empirically; the adjustable valve means embodied in cover 146 for each opening 145 being particularly useful for this purpose.

Regarding this latter example, it is important to note that the volume and pressure given for the airflow are concerned with a particular type of open-end spinning machine having trash collection chambers 30 which are quite small. However, if larger trash collection chambers, with large air inlet openings through the walls thereof, are employed with the bottom wall of the chamber and the air inlet openings thereof being spaced a substantial distance below the paths of the fibers to the rotors, it is to be understood that the volume and pressure of the airflow through each trash collection chamber could be such as to provide a substantially higher velocity airflow through each trash collection chamber than that indicated above without drawing usable fibers away from the paths of travel of the fibers to the rotors and without otherwise adversely affecting the yarn spinning operation of the rotors.

Referring now to FIGS. 6 and 7 there will be observed a modified form of trash removal system which is quite similar to the preferred form shown in FIG. 2 with the exception that the trash collection chambers of each machine are subjected to suction intermittently and in succession along the respective row or series of spinning unit. Accordingly, the beaters and those elements of FIG. 6 effecting the suction airflow through the rotors will bear the same reference characters as have been applied in the description of FIGS. 1, 2, 3 and 5, where applicable. However, those parts of the trash waste removal system shown in FIGS. 6 and 7 which are generally similar to those of the trash removal system shown in the lower portion of FIG. 2 will bear the same reference characters, but with the prime notation added, to avoid repetitive description.

By way of illustration, the trash removal system of FIGS. 6 and 7 is shown as being of the general type disclosed in the aforementioned Lane U.S. Pat. No. 3,777,329, to which reference is made for a more complete disclosure thereof. Accordingly, only a brief description of the modified form of trash waste removal system will be given herein. It will be observed in FIGS. 6 and 7 that the trash conveying tubes 31' from the respective spinning units 12 of the corresponding open-end spinning machine 10 are movably suppported by an elongate frame 130 and have their open lower ends positioned in registration with respective inlet ports 133 in the top wall of manifold conduit 131', but with the lower ends of the tubes 31' being spaced a relatively short distance above the latter top wall.

A flexible belt 135 runs along the upper surface of the top wall of manifold conduit 131' beneath the ends of tubes 31', and a sealing ring 136, of plastic or other suitable material, floats on the end of each tube 31' and substantially seals the belt 135 to the adjacent open end of each respective tube 31'. Belt 135 may be carried by end rollers 140, 141 suitably supported on opposite ends of trash conveying manifold conduit 131', and belt 135 may be driven at a relatively slow and adjustable rate of speed by any suitable means, not shown. Belt 135 is provided with one or more elongate slots or apertures therealong, only one of which is shown in FIG. 7 and indicated by the reference numeral 142. Slot 142 may be of such size as to register with ports 133 one at a time, or as shown and as is preferred, the slot 142 in belt 135 may register with two or more, but substantially less than all, of the ports 133 of the respective machine 10 at the same time.

In the operation of the trash removal apparatus, as illustrated in FIGS. 6 and 7, suction is applied to manifold conduit 131' from the primary airflow duct means 40 and through the small bore ducting 132' by the operation of common suction blower 70 (FIG. 1). Also, belt 135 is in motion and the sealing rings 136 on the lower ends of tubes 31' ride on the upper surface of the upper run of belt 135. It is apparent that belt 135 normally interrupts communication between tubes 31' and trash conveying manifold duct 131'.

As the upper run of belt 135 progresses along the top wall of manifold duct 131', slot 142 in belt 135 passes between the end of each successive tube 31' and the respective port 133 therebeneath. Thus, slot 142 serves to periodically effect a flow passage from each trash collection chamber 30 connected to the respective tube 31' and between each successive tube 31' and the respective port 133 in the trash conveying manifold conduit 131.

It is apparent that slot 142 extends in the direction of traverse of belt 135 and its length, together with the speed of belt 135, determines the length of time during which each successive trash collection chamber 30 is in communication with trash conveying manifold conduit 131'. Furthermore, it will be seen that in the illustrated embodiment, only two of the trash collection chambers are communicating with manifold conduit 131' at any given instant.

It is thus seen that there is provided an effective method and apparatus for maintaining a substantially constant high velocity flow of "spinning air" through the yarn spinning rotors 14 of all the open-end spinning machines in a group during their operation, while effectively disposing of fiber waste generated as an incident of the operation of the rotors and while removing trash waste liberated from the fibers in their paths of travel to the yarn spinning rotors of the respective machines. It is seen further that the removal of fiber waste from the yarn spinning rotors is effected by utilizing a primary airflow to draw air from the rotors of each machine 10 through a first passageway communicatively connecting the primary airflow duct 40 with the rotors, while also utilizing the primary airflow to draw air adjacent the paths of travel of the fibers to the rotors of each machine and through a respective second passageway providing communication between the primary airflow duct and the paths of travel of the fibers to the rotors.

From the foregoing description, it is also apparent that, in the preferred embodiment of the invention, upon the presence of any fire in the fiber waste being arrested by the filter 62 of any of the open-end spinning machines, such fire will be sensed while continuing operation of the respective machine to permit the airflow through the filter to have an opportunity to blow out the fire. Also, in the event of the fire still being sensed as present following a predetermined relatively short interval of time, as determined by time delay mechanism 65*a* for example, it can be seen that the operation of the respective spinning machine and the airflow through the respective filter 62 will be interrupted, and the fire still present in the fiber waste will be extinguished without interrupting the operation of the other spinning machines.

In the drawings and specification, there has been set forth preferred embodiments of the invention, and although specific terms are employed, they are used in a generic and descriptive sense only and not for purposes of limitation.

That which is claimed is:

1. A method of spinning yarns while removing fiber waste from yarn spinning rotors of a group of open-end spinning machines and also removing trash waste liberated from fibers in their paths of travel to the respective rotors, said method comprising producing a primary airflow through a duct to draw air past the rotors of each machine in the group and through a respective first passageway communicatively connected with the duct to remove fiber waste from the rotors of each machine in the group with such airflow, and while causing such primary airflow to also draw air adjacent the paths of travel of the fibers to the rotors of each machine in the group and through a respective second passageway communicatively connected with the duct to also remove trash waste liberated from the fibers with such airflow.

2. A method according to claim 1, in which the airflow past the rotors of each machine is continuous during the operation of each machine, and in which the airflow adjacent the paths of travel of the fibers to the rotors of each machine also is continuous.

3. A method according to claim 1, in which the airflow past the rotors of each machine is continuous during the operation of each machine, and in which the airflow adjacent the paths of travel of the fibers to the rotors of each machine is intermittent during the operation of the machine.

4. A method according to claim 1, which includes directing the fiber waste and trash waste from the respective first and second passageways of all the machines downstream in the primary airflow through the duct to a waste collection zone.

5. A method according to claim 1, which includes arresting the fiber waste from the yarn spinning rotors against a respective filter in the course of movement of the fiber waste through each first passageway, and periodically dislodging the arrested fiber waste from each filter so as to be entrained in the airflow downstream of the respective filter.

6. A method according to claim 5, which includes sensing the presence of any fire in the fiber waste being arrested by any of said filters and in response thereto interrupting the operation of the respective machine.

7. A method according to claim 6, wherein said sensing of the presence of any fire in the fiber waste being arrested by any of said filters comprises sensing the presence of any fire for a predetermined relatively short interval of time prior to interrupting the operation of the respective machine in response thereto so as to avoid interrupting the operation of the respective machine in the event the fire is blown out by the airflow through the filter during said predetermined interval of time.

8. A method according to claim 5, which includes sensing the presence of any fire in the fiber waste being arrested by any of said filters while continuing operation of the respective machine and the airflow through the respective filter so as to permit the airflow through the filter to have an opportunity to blow out the fire, interrupting operation of the respective machine and the airflow through the respective filter in the event of the fire still being sensed as being present following a predetermined relatively short interval of time and not having already been blown out by the airflow, and extinguishing the fire still present in the fiber waste.

9. A method of spinning yarns while removing fiber waste from yarn spinning rotors of a group of open-end spinning machines and also removing trash waste liberated from fibers in their paths of travel to the respective rotors, said method comprising producing a primary airflow through a duct to draw air at a high velocity past the rotors of each machine in the group and through a respective first passageway communicatively connected with the duct to remove fiber waste from the rotors of each machine in the group with such high velocity airflow, and while causing such primary airflow to also draw air at a substantially lower velocity adjacent the paths of travel of the fibers to the rotors of each machine in the group and through a respective second passageway communicatively connected with the duct to remove trash waste liberated from the fibers with such substantially lower velocity airflow.

10. A method according to claim 9, in which the high velocity airflow past the rotors of each machine is continuous during the operation of each machine, and in which the lower velocity airflow adjacent the paths of travel of the fibers to the rotors of each machine also is continuous.

11. A method according to claim 9, in which the high velocity airflow past the rotors of each machine is continuous during the operation of each machine, and in which the lower velocity airflow adjacent the paths of travel of the fibers to the rotors of each machine is intermittent during the operation of each machine.

12. A method according to claim 9, in which the high velocity airflow past the rotors of each machine is continuous during the operation of each machine, the paths of travel of the fibers to the rotors of each machine being arranged parallel to each other in a row, and wherein the method also includes intermittently interrupting the lower velocity airflow adjacent the paths of travel of the fibers in each row in succession.

13. A method according to claim 9, which includes directing the fiber waste and trash waste from the respective first and second passageways of all the machines downstream in the primary airflow through the duct to a waste collection zone.

14. A method according to claim 9, which includes directing the fiber waste from the first passageways and the trash waste from the second passageways downstream in the primary airflow to a waste collection zone, and which also inculdes arresting fiber waste from the yarn spinning rotors of each machine against a filter in the respective first passageway, and periodically dislodging the arrested fiber waste from the filters so as to be entrained in the airflow downstream of each respective filter.

15. A method according to claim 14, in which the step of periodically dislodging fiber waste from said filters includes periodically changing the position of each filter to cause fiber waste arrested against one side thereof to be removed by the airflow.

16. A method according to claim 14, in which the step of periodically dislodging fiber waste from said filters comprises periodically inverting each filter so that fiber waste arrested against one side thereof is removed therefrom by the airflow through the respective filter as other fiber waste from the yarn spinning rotors of the respective machine is being arrested against the other side of the respective filter.

17. A method according to claim 14, which includes detecting air pressure adjacent each of said filters, and wherein the step of periodically dislodging fiber waste from the filters comprises periodically changing the position of each filter in response to the detection of a predetermined air pressure condition adjacent the respective filter incident to the build-up of fiber waste thereon.

18. A method according to claim 14, in which the step of periodically dislodging fiber waste from said filters includes periodically changing the position of each filter to cause fiber waste arrested against one side thereof to be removed by the airflow, and the method further comprising sensing the presence of any fire in the fiber waste being arrested by any of said filters and in response thereto preventing the changing of the position of the respective filter to prevent the fire being sensed thereon from being conveyed downstream to the waste collection zone.

19. A method according to claim 14, which includes sensing the presence of any fire in the fiber waste being arrested by any of said filters and in response thereto interrupting the operation of the respective machine.

20. A method according to claim 19, wherein said sensing of the presence of any fire in the fiber waste being arrested by any of said filters comprises sensing the presence of any fire for a predetermined relatively short interval of time prior to interrupting the operation of the respective machine in response thereto so as to avoid interrupting the operation of the respective machine in the event the fire is blown out by the high velocity airflow through the filter during said predetermined interval of time.

21. A method according to claim 19, which further comprises interrupting communication between the filter of the respective machine and the duct for the primary airflow in response to said sensing of the presence of any fire in the fiber waste being arrested by the filter and without interrupting communication between the filters of the other machines in the group and the duct so that burning fiber waste will be prevented from being borne downstream from the filter to the waste collection zone by the airflow during the operation of the other machines in the group.

22. A method according to claim 14, which includes sensing the presence of any fire in the fiber waste being arrested by any of said filters while continuing operation of the respective machine and the high velocity airflow through the respective filter so as to permit the high velocity airflow through the filter to have an opportunity to blow out the fire, interrupting operation of the respective machine and the high velocity airflow through the respective filter in the event of the fire still being sensed as present following a predetermined relatively short interval of time and not having already been blown out by the high velocity airflow, and extinguishing the fire still present in the fiber waste.

23. A method according to claim 22, wherein the fire is extinguished substantially concurrently with the interrupting of the high velocity airflow through the respective filter.

24. A method of spinning yarns while removing fiber waste from yarn spinning rotors of a group of open-end spinning machines and also removing trash waste liberated from fibers in their paths of travel to the respective yarn spinning rotors and wherein the liberated trash waste is received in trash collection chambers adjacent and communicating with the respective paths of travel of the fibers, said method comprising producing a continuous primary suction airflow along a duct, inducing the continuous primary suction airflow to continuously draw air at a high velocity past the yarn spinning rotors of each machine and through a respective first passageway communicatively connected with the duct to remove fiber waste from the yarn spinning rotors of each machine with such high velocity airflow, and while also including the continuous primary suction airflow to draw air at a substantially lower velocity through the trash collection chambers of each machine and through a respective second passageway communicatively connected with the duct to remove trash waste from the trash collection chambers of each machine with such substantially lower velocity airflow.

25. A method according to claim 24, which includes directing the fiber waste and the trash waste from the respective passageways of all the machines downstream along the duct to a waste collection zone, arresting the fiber waste from the yarn spinning rotors against a respective filter in the course of movement of the fiber waste through each first passageway, and periodically dislodging the arrested fiber waste from each filter so as to be entrained in the airflow downstream of the respective filter.

26. A method of spinning yarns while removing fiber waste from yarn spinning rotors of a group of open-end spinning machines and of also removing trash waste liberated from fibers in their paths of travel to the respective rotors, said method comprising producing a primary airflow through a duct to draw air at a high velocity past the rotors of each machine in the group and through a respective first passageway communicatively connected with the duct to remove fiber waste from the yarn spinning rotors of each machine with such high velocity airflow, while also causing such primary airflow to draw air at a substantially lower velocity adjacent the paths of travel of the fibers to the rotors of each machine and through a respective second passageway communicatively connected with the duct to remove trash waste liberated from the fibers in their paths of travel to the rotors of each machine in the group with such substantially lower velocity airflow, while directing the fiber waste and trash waste from all of the respective passageways downstream in the duct to a waste collection zone, arresting the fiber waste from the yarn spinning rotors against a respective filter in the course of movement of the fiber waste through each first passageway, periodically disloding the arrested fiber waste from each filter so as to be entrained in the airflow downstream of the respective filter, sensing the presence of any fire in the fiber waste being arrested by any of the filters while continuing operation of the respective machine and the high velocity airflow through the respective filter so as to permit the high velocity airflow through the filter to have an opportunity to blow out the fire, and interrupting operation of the respective machine and the high velocity airflow through the respective filter in the event of the fire still being sensed as present following a predetermined relatively short interval of time and not having already been blown out by the high velocity airflow, and directing a fire extinguishing material into an area adjacent the respective filter to extinguish the fire still present in the fiber waste.

27. A method of spinning yarns while removing fiber waste from yarn spinning rotors of a group of open-end spinning machines and maintaining adequate spinning airflow through the rotors during operation thereof, and also removing trash waste liberated from fibers in their paths of travel past fiber feeding opener rollers to the respective rotors, said method comprising drawing air at a high velocity past the yarn spinning rotors of each machine in the group and through a respective first passageway communicating therewith by producing a suction air-stream at an area downstream of and communicating with all of the respective first passageways so that air flows along the first passageways toward such area and through a separate filter in each first passageway, while arresting fiber waste from the rotors against the respective filters, while also causing the suction airstream to draw air at a substantially lower velocity adjacent the paths of travel of the fibers past the respective opener rollers of each machine in the group and into a second passageway bypassing the respective filter to remove trash waste liberated from the fibers in their paths of travel to the respective rotors with such substantially lower velocity airflow, directing the trash waste from the second passageways downstream in the suction airstream to a waste collection zone, periodically dislodging the arrested fiber waste from the filters so as to be entrained in the airflow downstream of each respective filter, and also directing the thus dislodged and entrained fiber waste downstream in the suction airstream to the waste collection zone.

28. A method of spinning yarn while removing fiber waste from yarn spinning rotors of an open-end spinning machine and also removing trash waste liberated from fibers in their paths of travel to the respective rotors, said method comprising producing a primary suction airflow along a duct, inducing the primary suction airflow to draw air at a high velocity past the yarn spinning rotors of the machine and through a first passageway communicatively connected to the duct to remove fiber waste from the yarn spinning rotors with such high velocity air-flow, and while also inducing the primary suction airflow to draw air at a substantially lower velocity adjacent the paths of travel of the fibers to the rotors and through a second passageway communicatively connected with the duct to remove trash waste liberated from the fibers with such substantially lower velocity airflow.

29. A method according to claim 28, which includes directing the fiber waste and the trash waste from the respective first and second passageways of the machine downstream in the primary airflow duct to a waste collection zone.

30. A method according to claim 28, which includes directing the fiber waste and the trash waste from the respective passageways of the machine downstream in the primary airflow duct to a waste collection zone, arresting the fiber waste from the yarn spinning rotors against a filter in the course of movement of the fiber waste through the first passageway, and periodically dislodging the fiber waste from the filter so as to be entrained in the airflow downstream of the filter.

31. A method of spinning yarns while removing fiber waste from yarn spinning rotors of an open-end spinning machine and also removing trash waste liberated from fibers in their paths of travel of the respective rotors, said method comprising producing a primary airflow through a duct to draw air past the rotors and through a first passageway communicatively connected with the duct to remove fiber waste from the rotors, and while causing such primary airflow to also draw air adjacent the paths of travel of the fibers to the rotors and through a second passageway communicatively connected with the duct to remove trash waste liberated from the fibers, arresting the fiber waste from the yarn spinning rotors against a filter in the course of movement of the fiber waste through the first passageway, periodically dislodging the arrested fiber waste from the filter so as to be entrained in the airflow downstream of the filter, and directing the dislodged fiber waste and the trash waste from the respective first and second passageways of the machine downstream along the primary airflow duct to a waste collection zone.

32. A method according to claim 31, which includes sensing the presence of any fire in the fiber waste being arrested by said filter and in response thereto interrupting the operation of the machine.

33. A method according to claim 32, wherein said sensing of the presence of any fire in the fiber waste being arrested by said filter comprises sensing the presence of any such fire for a predetermined relatively short interval of time prior to interrupting the operation of the machine in response thereto so as to avoid interrupting the operation of the machine in the event the fire is blown out by the airflow through the filter during said predetermined interval of time.

34. A method according to claim 31, which includes sensing the presence of any fire in the fiber waste being arrested by the filter while continuing operation of the machine and the airflow through the filter so as to permit the airflow through the filter to have an opportunity to blow out the fire, interrupting operation of the machine and the airflow through the filter in the event of the fire still being sensed as present following a predetermined relatively short interval of time and not having already been blown out by the airflow, and extinguishing the fire still present in the fiber waste.

35. Apparatus for removing fiber waste from yarn spinning rotors of a group of open-end spinning machines and for removing trash waste liberated from fibers in their paths of travel to the respective rotors, and wherein each machine includes path-defining means for defining said paths of travel of the fibers to the respective yarn spinning rotors, said apparatus comprising a primary airflow duct, fan means for producing a primary airflow through said duct, a first passageway-defining means providing communication between said primary airflow duct and the yarn spinning rotors of each respective open-end spinning machine in the group and arranged so that the primary airflow will draw air from the rotors of each machine into said duct, and a second passageway-defining means providing communication between said primary airflow duct and said path-defining means of each respective open-end spinning machine in the group and arranged so that the primary airflow will draw air adjacent the paths of travel of the fibers to said rotors of each machine and into said duct whereby fiber waste is removed from the yarn spinning rotors of each machine by the air being drawn from the rotors through the respective first passageway-defining means into said duct, and trash waste liberated from the fibers in their paths of travel to the respective yarn spinning rotors of each machine is removed by the air being drawn adjacent the paths of travel of the fibers to the rotors of each machine and through the respective second passageway-defining means into said duct.

36. Apparatus according to claim 35, including means defining a waste collection zone communicating with said primary airflow duct downstream of said first and second passageway-defining means, a filter in each first passageway-defining means for arresting fiber waste thereagainst as the air flows from the yarn spinning rotors to said duct, and means for changing the position of each filter so that, when the position of the filter is changed, the airflow through the respective first passageway-defining means will dislodge fiber waste from the respective filter and convey such dislodged fiber waste to said collection zone to be collected with the trash waste being removed from the fibers in their paths of travel to said yarn spinning rotors.

37. Apparatus according to claim 36, including sensing means adjacent each filter for sensing the presence of any fire in the fiber waste being arrested by the respective filter, and means responsive to said sensing means sensing such a fire for rendering inoperative said means for changing the position of the respective filter so as to prevent the fire being sensed thereon from being conveyed downstream to said waste collection zone.

38. Apparatus according to claim 36, including sensing means adjacent each filter for sensing the presence of any fire in the fiber waste being arrested by the respective filter, a normally inactive fire extinguishing means adjacent each filter, and means responsive to said sensing means sensing a fire in the fiber waste being arrested by any of said filters for activating the respective fire extinguishing means to extinguish the fire.

39. Apparatus according to claim 38, wherein said means responsive to said sensing means comprises time delay means operatively connecting said sensing means to said respective fire extinguishing means for delaying the response of said fire extinguishing means for a predetermined relatively short interval of time prior to activating said fire extinguishing means and being operable to prevent activating said fire extinguishing means in the event the fire is blown out by the airflow through the respective filter during said predetermined short interval of time.

40. Apparatus according to claim 36, including means for driving each machine, a normally inactive fire extinguishing means communicating with each first passageway-defining means adjacent the respective filter, sensing means adjacent each of said filters for sensing the presence of any fire in the fiber waste being arrested by the respective filter, and means responsive to said sensing means sensing a fire in the fiber waste being arrested by any of said filters for interrupting the operation of the driving means of the respective machine and the airflow through the filter of the respective machine and for activating the respective fire extinguishing means to extinguish the fire.

41. Apparatus for removing fiber waste from yarn spinning rotors of a group of open-end spinning machines and for removing trash waste liberated from fibers in their paths of travel to the respective rotors, and wherein each machine includes path-defining means for defining said paths of travel of the fibers to the respective yarn spinning rotors, said apparatus comprising a primary airflow duct, fan means for producing a primary airflow through said duct, a first passageway-defining means providing communication between said primary air-flow duct and the yarn spinning rotors of each respective open-end spinning machine in the group and arranged so that the primary airflow will draw air at a high velocity from the rotors of each machine into said duct, and a second passageway-defining means providing communication between said primary airflow duct and said path-defining means of each respective open-end spinning machine in the group and arranged so that the primary airflow will draw air at a substantially lower velocity adjacent the paths of travel of the fibers to said rotors of each machine and into said duct whereby fiber waste is removed from the yarn spinning rotors of each machine with the high velocity airflow and trash waste liberated from the fibers in their paths of travel to the respective yarn spinning rotors of each machine is removed with the substantially lower velocity airflow.

42. Apparatus according to claim 41, including means defining a waste collection zone communicating with said primary airflow duct downstream of the first and second passageway-defining means of all the machines in said group.

43. Apparatus according to claim 41, including a filter positioned downstream of the first and second passageway-defining means and communicating with said primary airflow duct for receiving and collecting thereagainst waste material from said first and second passageway-defining means, and means operatively associated with said filter for removing collected waste material therefrom.

44. Apparatus according to claim 41, including a trash collection chamber adjacent each of said path-defining means of each machine for receiving therein the trash waste liberated from the fibers in their respective paths of travel to the rotors, and wherein said first and second passageway-defining means comprise respective first and second conduits, and first and second tube means connecting the yarn spinning rotors and the trash collection chambers of each machine in said group in communication with the respective first and second conduits, and each of said second passageway-defining means further comprising flow restricting means connecting each second conduit to said primary airflow duct and arranged to casue the air to flow from each second conduit into said primary airflow duct at a substantially lower velocity than the airflow from each first conduit into said duct.

45. Apparatus according to claim 44, including means defining a waste collection zone communicating with said primary airflow duct downstream of said first and second passageway-defining means, a filter in each first passageway-defining means for arresting fiber waste thereagainst as the air flows from the rotors to said duct, and means for changing the position of each filter so that, when the position of the filter is changed, the airflow through the respective first passageway-defining means will dislodge fiber waste from the respective filter and convey such dislodged fiber waste to said collection zone.

46. Apparatus according to claim 41, including adjustable valve means associated with each second passageway-defining means for adjustably varying said lower velocity air-flow adjacent said paths of travel of the fibers to the yarn spinning rotors of each machine.

47. Apparatus according to claim 46, wherein said adjustable valve means comprises means connected to each second passageway-defining means for permitting a predetermined flow of ambient air into each respective second passageway-defining means.

48. Apparatus according to claim 41, wherein said first and second passageway-defining means comprise respective first and second elongate conduits for each machine, said second passageway-defining means further comprising flow restricting means communicatively connecting each second conduit to said primary airflow duct and arranged to cause air to flow from each second conduit into said duct at a substantially lower velocity than the airflow from each first conduit into said duct, and adjustable valve means associated with each second conduit for adjustably varying said lower velocity airflow adjacent the respective paths of travel of the fibers to said yarn spinning rotors of each machine.

49. Apparatus according to claim 41, including means operatively associated with each second passageway-defining means for intermittently interrupting communication between said primary airflow duct and each of the paths of travel of the fibers to the responsive yarn spinning rotors of each machine in said group.

50. Apparatus according to claim 41, wherein said path-defining means are arranged in a series on each respective machine, and means operatively associated with each second passageway-defining means for intermittently interrupting communication between said primary airflow duct and said path-defining means in each series in succession.

51. Apparatus according to claim 41, including a trash collection chamber positioned adjacent each path-defining means and adapted to receive therein trash waste being liberated from the fibers, and wherein each second passageway-defining means comprises a conduit positioned adjacent said path-defining means of the respective machine, and means for connecting and disconnecting each trash collection chamber and the respective conduit for intermittently establishing communication between the conduit and the trash collection chambers of each machine in said group for removing trash waste from said trash collection chambers.

52. Apparatus for removing fiber waste from yarn spinning rotors of a group of open-end spinning machines and for removing trash waste liberated from fibers in their paths of travel to the respective rotors, and wherein each machine includes path-defining means for defining said paths of travel of the fibers to the respective yarn spinning rotors, said apparatus comprising a primary airflow duct, fan means communicating with said duct for producing a primary airflow therethrough, first passageway-defining means providing communication between said primary airflow duct and the yarn spinning rotors of each respective machine and arranged so that the primary airflow will draw air at a high velocity from the rotors of each machine into said duct, second passageway-defining means providing communication between said primary airflow duct and said path-defining means of each respective machine in said group and arranged so that the primary airflow will draw air at a substantially lower velocity adjacent the paths of travel of the fibers to the rotors of each machine and into said duct whereby fiber waste will be removed from the yarn spinning rotors of each machine in said group with the high velocity airflow and trash waste liberated from the fibers in their paths of travel to the respective yarn spinning rotors will be removed with the substantially lower velocity airflow, means defining a waste collection zone communicating with said duct downstream of all of said first and second passageway-defining means, a respective filter in each first passageway-defining means for arresting fiber waste thereagainst as the air flows from the yarn spinning rotors to said duct, and means for changing the position of each filter so that, when the position of the filter is changed, the airflow through the respective first passageway-defining means will dislodge fiber waste from the respective filter and convey such dislodged fiber waste to said collection zone to be collected with the trash waste being removed from the fibers in their paths of travel to said yarn spinning rotors.

53. Apparatus according to claim 52, including sensing means adjacent each filter for sensing the presence of any fire in the fiber waste being arrested by the respective filter, and means responsive to said sensing means sensing such a fire for rendering inoperative said means for changing of the position of the respective filter so as to prevent the fire being sensed thereon from being conveyed downstream to said waste collection zone.

54. Apparatus according to claim 52, including sensing means adjacent each filter for sensing the presence of any fire in the fiber waste being arrested by the respective filter, a normally inactive fire extinguishing means adjacent each filter, and means responsive to said sensing means sensing a fire in the fiber waste being arrested by any of said filters for activating the respective fire extinguishing means to extinguish the fire.

55. Apparatus according to claim 54, wherein said means responsive to said sensing means comprises time delay means operatively connecting said sensing means to said respective fire extinguishing means for delaying the response of said fire extinguishing means for a predetermined relatively short interval of time prior to activating said fire extinguishing means and being operable to prevent activating said fire extinguishing means in the event the fire is blown out by the high velocity airflow through the respective filter during said predetermined short interval of time.

56. Apparatus according to claim 52, including sensing means adjacent each filter for sensing the presence of any fire in the fiber waste arrested thereagainst, and means responsive to the sensing of such a fire for interrupting the airflow through the filter of the respective machine without reducing or interrupting the airflow through the filters of the other machines in said group.

57. Apparatus according to claim 56, wherein said means for interrupting the airflow through the filters of the respective machines comprises means for interrupting communication between each first passageway-defining means and the primary airflow duct at a location downstream of the respective filter.

58. Apparatus according to claim 56, including means for driving each machine, and means responsive to any of said sensing means sensing a fire for interrupting the operation of the driving means of the respective machine.

59. Apparatus according to claim 52, wherein said means for changing the position of each filter includes control means operatively connected to each of said filters for periodically changing the position thereof so as to cause fiber waste arrested thereagainst to be removed by the airflow.

60. Apparatus according to claim 52, including air pressure detecting means in each first passageway-defining means for detecting variations in pressure therein as effected by the accumulation of fiber waste on the respective filter, and means responsive to said detecting means detecting a predetermined pressure condition in each first passageway-defining means for changing the position of the respective filter so as to cause fiber waste previously arrested thereagainst to be dislodged therefrom by the air flowing therethrough.

61. Apparatus for removing fiber waste from yarn spinning rotors of a group of open-end spinning machines while maintaining adequate spinning airflow therethrough during operation thereof, and also for removing trash waste liberated from fibers in their paths of travel past fiber opener rollers to the respective rotors, said apparatus comprising a primary airflow duct, fan means for producing a suction airflow along said duct, first passageway-defining means providing communication between said primary airflow duct and the yarn spinning rotors of each respective machine in said group and arranged so that the suction airflow will draw air at a high velocity from the rotors of each machine into said duct, second passageway-defining means providing communication between said primary airflow duct and the opener rollers of each respective machine and arranged so that the suction airflow will draw air at a substantially lower velocity adjacent the paths of travel of the fibers past the opener rollers of each machine and into said duct whereby fiber waste will be removed from the yarn spinning rotors of each machine with the high velocity airflow and trash waste liberated from the fibers traveling past the opener rollers of each machine will be removed with the substantially lower velocity airflow, a waste collection zone including a filter communicating with said duct downstream of all of said first and second passageways for receiving waste material thereon from both passageway-defining means of the machines, a filter in each first passageway-defining means for arresting fiber waste thereagainst as the high velocity air flows from the yarn spinning rotors to said duct, and means for changing the position of the respective filter in each of said first passageway-defining means and including control means for periodically changing the position of each respective filter so as to cause fiber waste arrested thereagainst to be removed by the airflow and conveyed to said waste collection zone.

62. Apparatus for removing fiber waste from yarn spinning rotors of a group of open-end spinning machines and also removing trash waste liberated from fibers in their paths of travel to the respective rotors, said apparatus comprising a primary airflow duct, first and second passageway-defining means respectively communicatively connecting said duct with the rotors, and with the paths of travel of the fibers to the rotors, of each machine in said group, fan means producing a primary airflow through said duct for drawing air at a high velocity past the rotors of each machine in the group and through the respective first passageway-defining means into said duct to remove fiber waste from the yarn spinning rotors of each machine with such high velocity airflow, each second passageway-defining means being arranged to cause the primary airflow to also draw air at a substantially lower velocity adjacent the paths of travel of the fibers to the rotors of each machine and into said duct to remove trash waste liberated from the fibers in their paths of travel to the rotors of each machine in the group with such substantially lower velocity airflow, a filter in each first passageway-defining means for arresting thereagainst the fiber waste from the yarn spinning rotors of the respective machine, normally inactive fire extinguishing means communicating with each first passageway-defining means adjacent the respective filter therein, fire sensing means for sensing the presence of any fire in the fiber waste being arrested by any of the filters during continuing operation of the respective machine and during the high velocity airflow through the respective filter so as to permit the high velocity airflow through the filter to have an opportunity to blow out the fire, and means responsive to said fire sensing means for interrupting operation of the respective machine and the high velocity airflow through the respective filter and for activating the respective fire extinguishing means in the event of the fire still being sensed as present following a predetermined relatively short interval of time and not having already been blown out by the high velocity airflow.

63. Apparatus for removing fiber waste from yarn spinning rotors of an open-end spinning machine and for removing trash waste liberated from fibers in their paths of travel to the respective rotors, and wherein the machine includes pathdefining means for defining said paths of travel of the fibers to the respective yarn spinning rotors, said apparatus comprising fan means for producing a primary suction airflow, a first passageway-defining means providing communication between said fan means and the yarn spinning rotors of the machine and arranged so that the primary suction airflow will draw air at a high velocity from the rotors of the machine toward said fan means, and a second passageway-defining means providing communication between said fan means and said path-defining means of the machine and arranged so that the primary suction airflow will draw air at a substantially lower velocity adjacent the paths of travel of the fibers to said rotors and toward said fan means whereby fiber waste is removed from the yarn spinning rotors of the machine with the high velocity airflow and trash waste liberated from the fibers in their paths of travel to the respective yarn spinning rotors of the machine is removed with the substantially lower velocity airflow.

64. Apparatus according to claim 63, including means defining a waste collection zone communicating with said fan means downstream of said first and second passageway-defining means and arranged to receive therein waste material from said first and second passageway-defining means.

65. Apparatus according to claim 63, including a filter in said first passageway-defining means for arresting fiber waste thereagainst as the air flows from the rotors toward said fan means, and means for changing the position of said filter so that, when the position of the filter is changed, the airflow through said first passageway-defining means will dislodge fiber waste from the filter and convey such dislodged fiber waste downstream toward said fan means.

66. Apparatus for removing fiber waste from yarn spinning rotors of an open-end spinning machine and for removing trash waste liberated from fibers in their paths of travel to the respective rotors, and wherein the machine includes path-defining means for defining said paths of travel of the fibers to the respective yarn spinning rotors, said apparatus comprising fan means for producing a primary suction airflow, a first passageway-defining means providing communication between said fan means and the yarn spinning rotors of the machine and arranged so that the primary suction airflow will draw air from the rotors of the machine toward said fan means for removing fiber waste from the yarn spinning rotors, and a second passageway-defining means providing communication between said fan means and said path-defining means of the machine and arranged so that the primary suction airflow will draw air adjacent the paths of travel of the fibers to said rotors and toward said fan means for removing trash waste liberated from the fibers in their paths of travel to the respective yarn spinning rotors of the machine, means defining a waste collection zone communicating with said fan means downstream of said first and second passageway-defining means and arranged to receive therein waste material from said first and second passageway-defining means, a filter in said first passageway-defining means for arresting fiber waste thereagainst as the air flows from the rotors toward said fan means, and means for changing the position of said filter so that, when the position of the filter is changed, the airflow through said first passageway-defining means will dislodge fiber waste from the filter and convey such dislodged fiber waste to said waste collection zone to be collected with the trash waste being removed from the fibers in their paths of travel to said yarn spinning rotors.

67. Apparatus according to claim 66, including sensing means adjacent said filter for sensing the presence of any fire in the fiber waste being arrested by said filter, a normally inactive fire extinguishing means adjacent said filter, and means responsive to said sensing means sensing a fire in the fiber waste being arrested by said filter for activating the respective fire extinguishing means to extinguish the fire.

68. Apparatus according to claim 67, wherein said means responsive to said sensing means comprises time delay means operatively connecting said sensing means to said fire extinguishing means for delaying the response of said fire extinguishing means for a predetermined relatively short interval of time prior to activating said fire extinguishing means and being operable to prevent activating said fire extinguishing means in the event the fire is blown out by the airflow through said filter during said predetermined short interval of time.

69. Apparatus according to claim 66, including means for driving said machine, a normally inactive fire extinguishing means adjacent said filter, sensing means adjacent said filter for sensing the presence of any fire in the fiber waste being arrested by the filter, and means responsive to said sensing means sensing a fire in the fiber waste being arrested by said filter for interrupting the operation of the driving means of the machine and the airflow through the filter and for activating the fire extinguishing means to extinguish the fire.

* * * * *

UNITED STATES PATENT AND TRADEMARK OFFICE

CERTIFICATE OF CORRECTION

PATENT NO. : 3,953,961

DATED : May 4, 1976

INVENTOR(S) : John Harrap et al

It is certified that error appears in the above-identified patent and that said Letters Patent are hereby corrected as shown below:

Column 1, Line 11, "Serial No. 366,933" should be --Serial No. 366,963--
Column 2, Line 4, delete the first occurrence of "to"
Column 3, Line 6, "crosssec" should be --cross-sec- --
Column 4, Line 41, "motor" should be --rotor--; Line 65, "passage-defining" should be --passageway-defining--.
Column 6, Line 38, "simple" should be --ample--
Column 7, Line 5, "surfce" should be --surface--; Line 60, "a" should be --in--. Column 17, CLAIM 18, Line 45, "the method" should be --said method--. Column 18, CLAIM 24, Line 41, "including" should be --inducing--. Column 23, CLAIM 44, Line 4, "casue" should be --cause--. Line 49, CLAIM 49, "respon" should be --respec--; Line 50, same claim, "sive" should be --tive--

Signed and Sealed this

Seventeenth Day of August 1976

[SEAL]

*Attest:*

RUTH C. MASON
*Attesting Officer*

C. MARSHALL DANN
*Commissioner of Patents and Trademarks*